US010837079B2

(12) United States Patent
Liimatainen et al.

(10) Patent No.: US 10,837,079 B2
(45) Date of Patent: Nov. 17, 2020

(54) HOT-ROLLED ULTRAHIGH STRENGTH STEEL STRIP PRODUCT

(71) Applicant: RAUTARUUKKI OYJ, Helsinki (FI)

(72) Inventors: Tommi Liimatainen, Helsinki (FI); Mikko Hemmilä, Helsinki (FI); Pasi Suikkanen, Helsinki (FI); Juha Erkkilä, Helsinki (FI); Kati Rytinki, Helsinki (FI); Tuomo Saarinen, Helsinki (FI); Teijo Limnell, Helsinki (FI)

(73) Assignee: RAUTARUUKKI OYJ, Helsinki (FI)

( * ) Notice: Subject to any disclaimer, the term of this patent is extended or adjusted under 35 U.S.C. 154(b) by 540 days.

(21) Appl. No.: 15/111,332

(22) PCT Filed: Jan. 23, 2015

(86) PCT No.: PCT/EP2015/051371

§ 371 (c)(1),
(2) Date: Jul. 13, 2016

(87) PCT Pub. No.: WO2015/110585

PCT Pub. Date: Jul. 30, 2015

(65) Prior Publication Data

US 2016/0333440 A1 Nov. 17, 2016

(30) Foreign Application Priority Data

Jan. 24, 2014 (FI) ..... 20140020

(51) Int. Cl.
*C21D 9/52* (2006.01)
*C21D 9/46* (2006.01)
(Continued)

(52) U.S. Cl.
CPC ..... *C21D 9/52* (2013.01); *C21D 8/0205* (2013.01); *C21D 8/0226* (2013.01);
(Continued)

(58) Field of Classification Search
None
See application file for complete search history.

(56) References Cited

U.S. PATENT DOCUMENTS 4,388,122 A * 6/1983 Sudo ..... C21D 1/02 148/320
7,699,947 B2 * 4/2010 Seux ..... C21D 8/0226 148/333
(Continued)

FOREIGN PATENT DOCUMENTS

CN 101535518 9/2009
CN 101906567 12/2010
(Continued)

OTHER PUBLICATIONS

Translation of Lee in KR 2013/0110638, Oct. 2013 (Year: 2013).*
(Continued)

*Primary Examiner* — Sheng H Davis
(74) *Attorney, Agent, or Firm* — Ballard Spahr LLP

(57) ABSTRACT

The present invention relates to thin hot-rolled ultrahigh strength steel (UHSS) products, i.e. to hot-rolled steel strips with ultrahigh strength and good bendability. The object of the present invention is to provide an ultrahigh strength hot-rolled steel product that is having yield strength $R_{p0.2}$ at least 840 MPa and improved bendability. Further, a preferred aim is also to achieve an ultrahigh strength steel strip with excellent low temperature impact toughness. The inventors of the present invention have surprisingly found that the bendability of directly quenched ultrahigh strength steel strip can be significantly improved by producing a microstructure comprising upper bainite as main phase and by having a hot-rolled steel strip product having a yield strength $R_{p0.2}$ at least 840 MPa and a thickness of less than 12 mm, whose composition in percentage by weight is C: 0.03-0.08, Si: 0.01-0.8, Mn: 0.8-2.5, Al: 0.01-0.15, Cr:
(Continued)

0.01-2.0, B: 0.0005-0.005 Nb: 0.005-0.07, Ti: 0.005-0.12, N:<0.01, P:<0.02, S:<0.004, and optionally Ca less than 0.01, V less than 0.1, Mo less than 0.5, Cu less than 0.5 and Hi less than 0.5, the rest being Fe and unavoidable impurities.

12 Claims, 2 Drawing Sheets

(51) Int. Cl.

| | |
|---|---|
| ***C21D 8/04*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/12*** | (2006.01) |
| ***C22C 38/00*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.

CPC ..... *C21D 8/0263* (2013.01); *C21D 8/0426* (2013.01); *C21D 8/0463* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/002* (2013.01); *C21D 2211/008* (2013.01)

(56) References Cited

U.S. PATENT DOCUMENTS

| | | | | |
|---|---|---|---|---|
| 2009/0301338 | A1* | 12/2009 | Schmitz | F42B 7/046 102/448 |
| 2010/0132854 | A1* | 6/2010 | Cola, Jr. | C21D 1/08 148/575 |
| 2011/0186182 | A1* | 8/2011 | Chida | B32B 15/04 148/318 |
| 2013/0087253 | A1* | 4/2013 | Matsuda | C21D 9/46 148/533 |
| 2014/0230970 | A1* | 8/2014 | Perlade | B65G 45/10 148/522 |
| 2014/0251512 | A1* | 9/2014 | Gomez | C22C 38/32 148/590 |
| 2014/0322559 | A1* | 10/2014 | Becker | C21D 1/19 428/659 |
| 2015/0204071 | A1* | 7/2015 | Mizoguchi | B21B 1/088 52/837 |

FOREIGN PATENT DOCUMENTS

| | | | |
|---|---|---|---|
| CN | 103097556 | | 5/2013 |
| EP | 1 865 083 | | 12/2007 |
| EP | 1 375 694 | | 11/2010 |
| JP | 2012-188731 | | 10/2012 |
| KR | 20130110638 | * | 10/2013 |
| WO | WO 2007/051080 | | 5/2007 |
| WO | WO 2008/054166 | | 5/2008 |
| WO | WO 2011/154831 | | 12/2011 |
| WO | 2012127136 | * | 9/2012 |
| WO | 2012156428 | * | 11/2012 |
| WO | WO 2013/007729 | | 1/2013 |
| WO | 2014080818 | * | 5/2014 |

OTHER PUBLICATIONS

International Search Report for PCT/EP2015/051371, dated Jul. 8, 2015, 3 pages.

Chinese First Office Action dated Aug. 15, 2017 in CN Application 20150005443.2 and English translation, 9 pages.

* cited by examiner

HOT-ROLLED ULTRAHIGH STRENGTH STEEL STRIP PRODUCT

This application is the U.S. national phase of International Application No. PCT/EP2015/051371 filed 23 Jan. 2015, which designated the U.S. and claims priority to FI Patent Application No. 20140020 filed 24 Jan. 2014, the entire contents of each of which are hereby incorporated by reference.

FIELD OF THE PRESENT INVENTION

The present invention relates to thin hot-rolled ultrahigh strength steel (UHSS) products, and more specifically to hot-rolled steel strips, with ultrahigh strength and good bendability which strips are used for instance in frame structures of vehicles, other mobile constructions or other structures that require light weight.

BACKGROUND

High and ultra-ultrahigh strength (HSS/UHSS) hot-rolled steel products having low thickness, i.e. steel strip products, are popularly used for instance in vehicles or other mobile constructions that require light weight structures. The strength of modern HSS/UHSS provides an excellent final outcome especially in hot-rolled steel strips having low thickness. Use of low thickness steels (enabled by ultrahigh strength) decreases the total weight of construction resulting in reduced $CO_2$ emissions, for instance.

EP1375694 B2 (PL1) discloses high performance direct quenched steel strip for instance in terms of strength and impact toughness. However, it is well known phenomena that the minimum permissible internal bending radius raises when the thickness of the steel material raises, although it is usually given as proportional to thickness (t). For this reason the steel strip according to above referred patent has achieved a minimum permissible internal bending radius of 3.5*t measured in both bending directions in relation to rolling direction up to thickness of 12 mm, but a lower value has been difficult to achieve without compromising with other properties, especially in the thickness range of 10-12 mm. In addition it has been found problematic to solve the excellent combination of strength, bendability and low temperature toughness, especially when the thickness is in the thickness range of 10-12 mm. As can be seen the carbon content of steels according to PL1 has been at least 0.08%.

WO2013/007729 A1 (PL2) discloses hot-rolled high-strength steel strip with improved HAZ-softening resistance and method of producing said steel. PL2 does not disclose bendability results and teaches that good bendability of this type of product is obtained by limiting the content of P and S in the steel. Further PL2 is targeted for steel having yield strength at least 960 MPa and high carbon content.

WO2007/051080 A2 (PL3) discloses high strength dual phase steel with low yield ratio. The steel according to PL3 is produced by distinguishable cooling process and is not suitable to be used as a structural steel due to the low yield ratio typical for dual phase steels. Further PL3 relates to plate steels having a thickness of more than 16 mm as shown in the examples and still further PL3 does not disclose teachings relating to bendability.

Therefore an ultra-high strength steel strip, that possesses a yield ratio ($R_{p0.2}/R_m$) of more than 0.85 therefore being suitable to be used as structural steel, and that possesses an excellent bendability up to 12 mm would be highly desired to further improve the usability of high performance thin direct quenched steel products.

Object

An object of the invention is at least to alleviate or even eliminate the problems and drawbacks relating to the known prior art by providing an ultrahigh strength hot-rolled steel product, that possesses a yield strength $R_{p0.2}$ of at least 840 MPa and improved bendability. Further, a preferred aim is also to achieve an ultrahigh strength steel strip with excellent low temperature impact toughness.

The object is achieved with the hot-rolled steel strip product according to claim 1. Dependent claims 2-10 disclose preferred embodiments.

Short Description

The inventors of the present invention have surprisingly found that the bendability of directly quenched ultrahigh strength steel strip that is having a yield strength $R_{p0.2}$ of at least 840 MPa and a yield ratio ($R_{p0.2}/R_m$) of more than 0.85 can be significantly improved by producing a microstructure comprising upper bainite and by applying a low carbon content (0.03-0.08 wt-%) together with a other specified composition, in particular together with carefully defined niobium alloying content (0.005-0.07 wt-%).

Usually upper bainite microstructure is formed by using higher content of carbon leading to significant volume fraction of cementite in the microstructure, which satisfies ultra-high strength but debilitates the bendability and toughness for instance. However, in the present invention, it has been found that upper bainite can satisfy the ultrahigh strength even with low level of carbon provided that the composition is according to the present invention. A low carbon content also prevents significant amount of martensite to form in the microstructure during intensive strip cooling process, which provides for more homogenous microstructure, which is beneficial especially for excellent bendability characteristic. The composition according to the present invention enables the formation of upper bainitic at a low temperature.

Shortened lath size of the upper bainite and low volume fraction of cementite are therefore at least partly behind the extremely high performance mechanical properties. Further, the composition and thermomechanical processing according to the method of the present invention enables formation of upper bainite at a low temperature, which further narrows the shortened bainitic laths resulting in excellent strength-toughness balance of steel strip product. Bainite formation at low temperature increases the strength and reduces the thickness of the laths of upper bainite which increases the low temperature toughness. To sum up, the resulting upper bainite microstructure is extremely finely structured.

The composition of the steel strip product in percentage by weight is

C: 0.03-0.08,
Si: 0.01-0.8,
Mn: 0.8-2.5,
Al: 0.01-0.15,
Cr: 0.01-2.0,
B: 0.0005-0.005,
Nb: 0.005-0.07,
Ti: 0.005-0.12,
N:<0.01,
P:<0.02,
S:<0.004,
and optionally Ca less than 0.01, V less than 0.1, Mo less than 0.5, Cu less than 0.5 and Ni less than 0.5, the rest being Fe and unavoidable impurities.

According to the present invention, the hot-rolled steel strip product having a yield of at least 840 MPa, a yield ratio ($R_{p0.2}/R_m$) of more than 0.85, a thickness of less than 12 mm and having the above mentioned composition in percentage by weight has a microstructure comprising upper bainite, preferably as main phase and more preferably more than 50%.

Benefits

The present invention enables an ultrahigh strength hot-rolled steel strip product having a yield strength $R_{p0.2}$ of at least 840 MPa together with excellent bendability. Further, a tempering treatment is not needed meaning that the processing can be solely thermo-mechanical which means significant savings over typical quenched and tempered (QT) steels. Additionally excellent properties in terms of low temperature impact toughness are enabled, as shown by experiments. Finally, the invention enables producing 840-959 MPa steel strip with reduced alloying costs.

BRIEF DESCRIPTION OF THE ABBREVIATIONS AND DEFINITIONS

PAG prior austenite grain

GB granular bainite

QPF quasi polygonal ferrite

UB upper bainite

MA-constituent martensite austenite constituent

HT heating temperature

Figure 1:
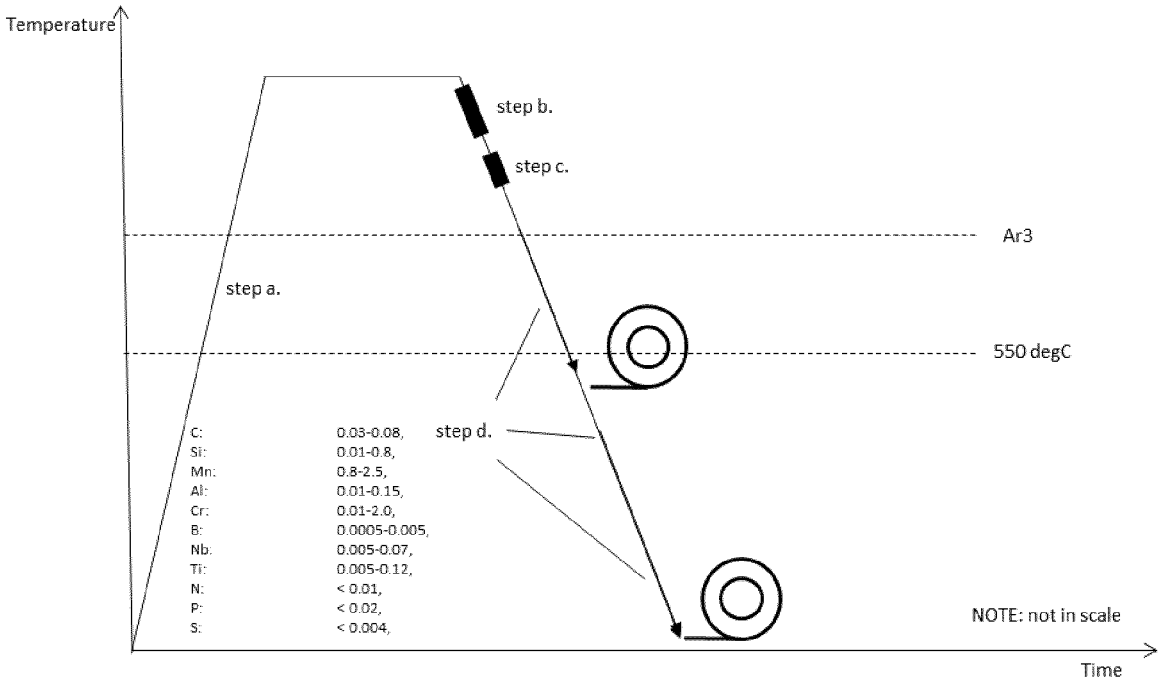
FIG. 1 is showing schematically the thermo-mechanical treatments.

FRT final rolling temperature $A_{r3}$ a temperature at which austenite begins to transform to ferrite during cooling QST quenching stop temperature Ultrahigh strength means here that yield strength $R_{p0.2}$ is at least 840 MPa. However preferably it means that yield strength $R_{p0.2}$ is more than 900 MPa. Performance of the present invention may limit to a yield strength $R_{p0.2}$ up to 1050 MPa, or 959 MPa, and one of these is preferably applied as upper limit of yield strength $R_{p0.2}$.

Excellent bendability means that steel strips up to 12 mm can be bent with a bending radius of less than 3.5*t in both directions in relation to rolling direction, without visually noticeably cracks or surface waviness in the bend. The present invention however enables that steel strips up to 12 mm can be bent with a bending radius of less than 3.01 in both directions in relation to rolling direction, without visually noticeably cracks or surface waviness in the bend. Therefore such value is preferably used as a minimum permissible internal bending radius.

Excellent low temperature impact toughness means here that Charpy-V impact toughness values measured at −60° C. is higher than 50 J/cm$^2$. This Charpy-V value is defined as an average of three Charpy-V test repetitions.

DETAILED DESCRIPTION

Next the chemical composition is explained in more detailed:

Carbon C content is in the range of 0.03-0.08 wt-% which is very low taking into account the targeted strength level. If the carbon content is less than 0.03 wt-%, the desired microstructure and the strength is not obtained without using expensive alloying elements excessively. For the same reasons, preferably the lower limit of carbon is 0.04 wt-% or 0.05 wt-%. On the other hand, if the carbon content is more than 0.08 wt-%, the volume fraction of cementite and/or martensitic structures becomes too high resulting in poor bendability and low temperature impact toughness. For the same reasons, preferably carbon content is less than 0.075 wt-% or more preferably less than 0.07 wt-%.

Silicon Si content is in the range of 0.01-0.8 wt-%. Silicon increases the strength advantageously by solid-solution strengthening. Further it may be existing due to the killing process (de-oxidation) and/or Ca—Si treatment. For these reasons, the lower limit of Si is 0.01 wt-%, but preferably the lower limit is 0.10 wt-%. However, if the Si content is higher than 0.8 wt-%, for instance due to the red-scale formation, the surface quality will suffer. For this reason, preferably the Si content is less than 0.50 wt-% or less than 0.30 wt-%.

Manganese Mn content is in the range of 0.8-2.5 wt-% because Mn provides the strength with relatively low costs. At least 0.8 wt-% is needed to satisfy the targeted yield strength $R_{p0.2}$ range cost-effectively. Further, Mn lowers the bainite start temperature very effectively thereby improving the desired microstructure. For this reason, preferably the lower limit of Mn is 1.2 wt-%. On the other hand, if the Mn is higher than 2.5 wt-%, then the hardenability would be too high to accomplish the desired microstructure and also weldability would suffer. For these reasons, preferably the upper limit of Mn is 1.8 wt-%.

Aluminium Al content is in the range of 0.01-0.15 wt-% due the killing (deoxidation) process. Further Al can decrease bendability in some cases, because it increases risk that aluminium oxides ($Al_2O_3$) are formed. Aluminium oxides have a negative effect to impact toughness and bendability of the steel.

Chromium Cr content is in the range of 0.01-2.0 wt-%, because it increases the strength effectively and lowers the bainite start temperature thereby improving the desired microstructure. On the other hand Cr content more than 2.0 wt-% would unnecessarily increase the alloying costs and further debilitate toughness of this steel. Therefore, preferably the upper limit for Cr is 1.0 wt-%, or more preferably the upper limit of Cr is 0.6 wt-%.

Boron B is an important alloying element in this invention and content of boron is in the range of 0.0005-0.005 wt-%, because it increases the strength effectively and provides that soft polygonal ferrite is not formed significantly to the microstructure. If boron content is less than 0.0005 wt-%, such effect is not achieved and on the other hand if the boron content is higher than 0.005 wt-% the effect will not increase substantially. Also upper limit of 0.003 wt-% for B could be applied.

Niobium Nb content is in the range of 0.005-0.07 wt-%, because the use of niobium enables that the resulting upper bainite microstructure is extremely finely structured. Further Nb increases the strength and toughness of steel by precipitation and/or grain refining improvements. Therefore preferably a lower limit of 0.02 wt-% for Nb is applied. However, if the niobium content is higher than 0.07 wt-%, substantially upper bainitic microstructure is not necessarily obtained due to the stronger austenite decomposition into softer micro structural phases. This would result in that desired strength level is not achieved with reasonable cooling powers and without using higher contents of other alloying elements. For the same reasons, preferably upper limit of 0.05 wt-% for Nb is applied. Also, if the upper limit of Nb is 0.07 wt-% or preferably 0.05 wt-%, it is possible to reduce rolling forces during manufacturing process, which makes possible to manufacture larger dimensional range.

Titanium Ti content is in the range of 0.005-0.12 wt-%, because it increases the strength and toughness of steel by precipitation and/or grain refining improvements. At least 0.005 wt-% is needed to ensure this effect. However, a Ti content higher than 0.12 wt-% is not needed and this could even debilitate the impact toughness, therefore preferably the upper limit for Ti is 0.03 wt-%, in which later case the titanium has mainly the function of ensuring the function of boron.

Further the following unavoidable impurities should be restricted accordingly, in order to ensure good mechanical behavior, especially in terms of impact toughness, of the steel product. Nitrogen N is less than 0.01 wt-%, phosphorous P is less than 0.02 wt-%, preferably less than 0.015 wt-% and sulfur S is less than 0.01 wt-%, preferably less than 0.005 wt-%.

Still further steel may contain optionally Calcium Ca less than 0.01 wt-%, Vanadium V less than 0.1 wt-% (preferably less than 0.05 wt-%), Molybdenum Mo less than 0.5 wt-% (preferably less than 0.1 wt-%), Copper Cu less than 0.5 wt-% (preferably less than 0.2 wt-%) and Nickel Ni less than 0.5 wt-% (preferably less than 0.1 wt-%).

The rest of the steel composition is iron Fe and unavoidable impurities that exist normally in the steel. Steel is provided in a form of steel slab, thin cast slab such as cast strip or other suitable form (hereinafter referred just slab).

Generally the bainite start (Bs) temperature (in ° C.) can be defined by the following equation (1):

$$Bs=830-270*C-90*Mn-37*Ni-70*Cr-83*Mo \quad (1)$$

where C, Mn, Ni, Cr and Mo are the amounts of respective elements in the steel in wt-%.

The inventors have found that bainite start (Bs) temperature (defined by equation (1)) should preferably be proportional to niobium Nb content according to the following condition:

$$Bs<692.1-421.1Nb,$$

where Nb is the amount of Nb in the steel in wt-%.

This aforementioned embodiment enables that the bainite formation will begin at low enough temperature in relation to the Nb-alloying.

More preferably bainite start (Bs) temperature (defined by equation (1)) should be proportional to niobium Nb content according to the following condition:

$$602.1-421.1*Nb<Bs<692.1-421.1Nb,$$

where Nb is the amount of Nb in the steel in wt-%.

This aforementioned second embodiment enables that the bainite formation will begin at low enough but not too low temperature in relation to the Nb-alloying. This helps that the microstructure remains essentially bainitic, not martensitic.

The product according to the present invention can be obtained for example by the method for manufacturing a hot-rolled steel strip product having a yield strength $R_{p0.2}$ at least 840 MPa and a thickness of less than 12 mm, by using steel slab whose composition in percentage by weight is C: 0.03-0.08,
Si: 0.01-0.8,
Mn: 0.8-2.5,
Al: 0.01-0.15,
Cr: 0.01-2.0,
B: 0.0005-0.005,
Nb: 0.005-0.07,
Ti: 0.005-0.12,
N: <0.01,
P: <0.02,
S: <0.004, and optionally Ca less than 0.01, V less than 0.1, Mo less than 0.5, Cu less than 0.5 and Ni less than 0.5, the rest being Fe and unavoidable impurities, comprises the following steps a-d:

a. austenitizing said steel slab at a temperature in the range of 1200 to 1350° C.,
b. reducing said steel slab to a transfer bar in one or more hot rolling passes at a temperature range in which austenite recrystallizes,
c. further reducing said transfer bar to a steel strip in one or more hot-rolling passes of a strip rolling mill and by using final rolling temperature higher than $A_{r3}$,
d. direct quenching said steel strip after the last pass in the strip rolling mill by using cooling rate of at least 25° C./to a quenching stop temperature (QST) lower than 550° C.

Next the steps included to the method and variants thereof are disclosed in more detail.

As shown in FIG. 1, the method for manufacturing hot-rolled steel strip comprises step (a) for austenitizing said steel slab at a temperature in the range of 1200 to 1350° C. In addition to austenitizing, this step (a) provides for desired dissolving of alloying elements and cast segregations to the solution. Heating to a temperature higher than 1350° C. is needless and may even lead to excessive coarsening of austenite grains. On the other hand, if temperature the austenitizing is less than 1200° C., the austenite is not necessarily homogenous enough and further the temperature control in the hot-rolling steps (b and c) may become complicated. As shown in FIG. 1, the austenitizing step (a), in addition to heating step, comprises also the equalizing step, in which the steel slab is hold in heating equipment for a time period that is required to achieve the uniform temperature distribution to the steel slab.

Subsequent to the austenitizing step (a), the method comprises step (b) for reducing said steel slab to a transfer bar in one or more hot rolling passes at a temperature range in which austenite recrystallizes. Also, in this step the hot-rolling reduces the thickness of the steel slab, for example from 210 mm to 30 mm, thereby also significantly refining the PAG mainly by static recrystallization. This step (b) for hot-rolling may be performed in pre-rolling mill separated from the strip rolling mill. In this hot-rolling step (b) said steel slab is converted into so-called transfer bar. The temperature range of this step (b) may be for example 900-1150° C. Next, the transfer bar may be guided to the coil box before following steps.

The temperature that defines the boundary between austenite re crystallization temperature range and austenite non-recrystallization temperature range is dependent on steel chemistry, austenitizing temperature and rolling reductions, for instance. It can be estimated by various equations available in the art, such as well-known $T_{nr}$ temperature. A person skilled in the art can determine this recrystallization limit temperature for each particular case either by experimentally or by model calculation.

Said transfer bar is further reduced in step (c) to a steel strip in one or more hot-rolling passes of a strip rolling mill. The finish rolling temperature should be above $A_{r3}$ temperature to avoid rolling in the dual-phase area, which would impair the desired mechanical properties and sheet flatness. In this strip-rolling step (c) the so-called transfer bar is converted into steel strip. Preferably, but not necessarily, the finish rolling temperature (FRT) is in the range of 850-950° C.

After the last pass in the strip rolling mill, said steel strip is direct quenched in step (d) by using a cooling rate of at least 25° C./s to a quenching stop temperature (QST) lower than 550° C. This step is essential to provide the microstructure of the step strip product that comprises upper bainite, preferably as main phase or and more preferably more than 50%. If the QST is higher than 550° C. the microstructure may contain too much polygonal ferrite or perlite, which debilitates the desired mechanical properties related to strength and toughness. Also, if the QST is higher than 550° C. the laths of the upper bainite will not be fine enough, which debilitates impact toughness and strength of the steel. After step (d) comprising direct quenching, said quenched steel strip may be coiled, if needed.

Preferably said direct quenching step (d) is a single cooling step meaning that no intermediate holding phases or such are kept during this step. In other words, the cooling rate during this step is substantially constant.

Preferably said quenching stop temperature (QST) is in the range of 400° C. to room temperature. The effect of the lower QST and the resulting lower coiling temperature is that the bainitic microstructure is tempered less; the result of this is higher strength for the steel strip.

A hot-rolled steel strip product according to the present invention is having a yield strength $R_{p0.2}$ at least 840 MPa. Further the steel strip has a thickness of less than 12 mm. The chemical composition ranges and reasons were explained in greater detail above.

As explained earlier, this hot-rolled steel strip product according to the present invention is having a microstructure comprising upper bainite, preferably as main phase and more preferably more than 50%. More preferably this main phase comprising upper bainite is having more than 60% or more than 80% area fraction.

Said upper bainite is lath shaped microstructural phase, which consists mainly of bainitic ferrite laths that are approximately parallel to each other and also of intragranularily nucleated acicular ferrite. In addition between the laths there exist fine cementite particles and/or "stringers". Due to the chemical composition and thermomechanical treatment of the present invention, said laths are shortened and narrowed which provides for excellent mechanical behavior, as shown in the experiments.

It is advantageous for bendability that the microstructure of the steel strip does not contain much martensite, MA-constituents, perlite or polygonal ferrite, and therefore upper limit for their total content may be 20%, preferably 10% and more preferably 5%. This type of substantially homogeneous microstructure consisting substantially of upper bainite, i.e. wherein the upper bainite is comprised as main phase of the microstructure, is favorable for excellent mechanical behavior, especially for bendability.

All microstructural features are defined by measuring from a plane which is locating at ¼ depth of the thickness (t) from the surface of the strip product. Further percentages of microstructural phases are given in terms of area percentages at such plane. With the expression main phase above is meant the predominant phase in the microstructure.

Figure 2:
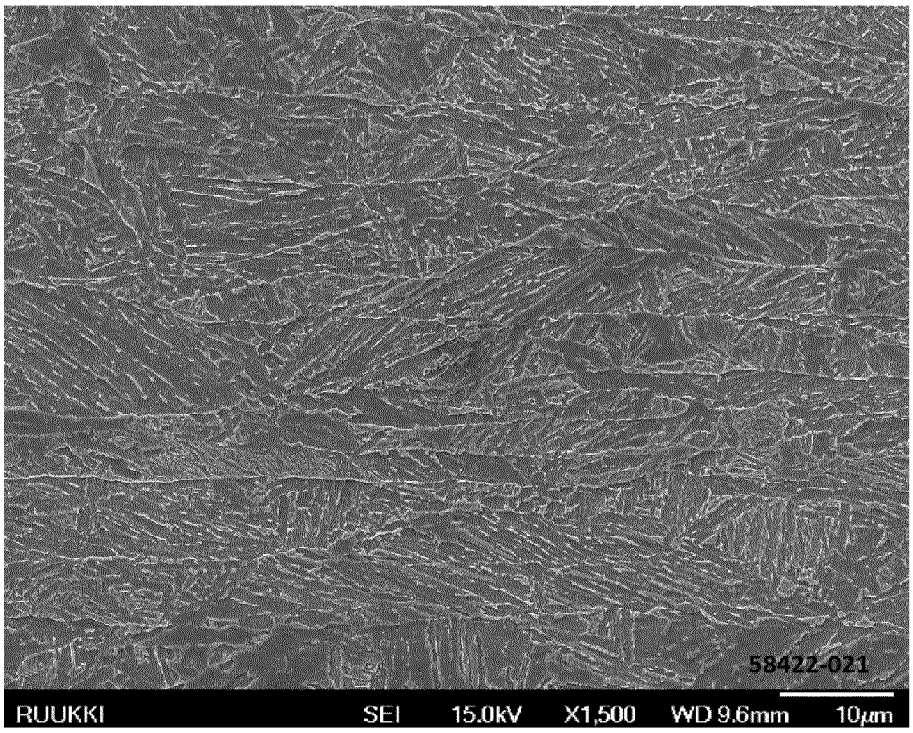
FIG. 2 is showing the SEM (scanning electron microscope)-graph of a microstructure of a steel strip according to one embodiment of the present invention.
Figure 3:
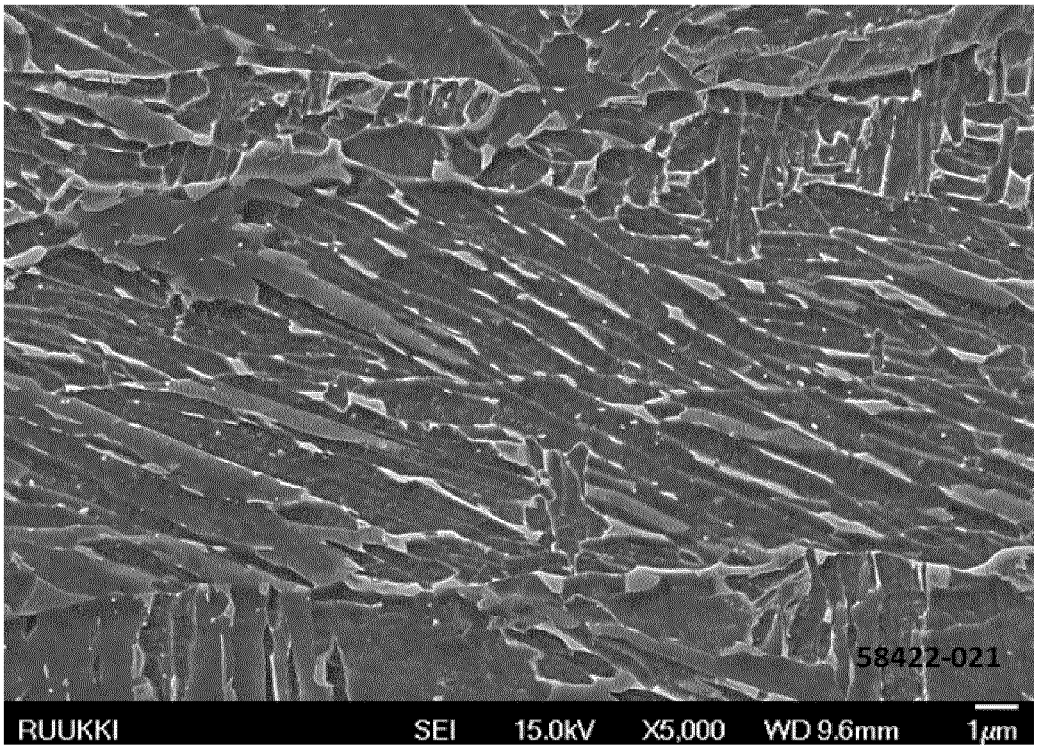
FIG. 3 is showing an enlarged view of FIG. 2.

Example of microstructure is shown in FIG. 2 wherein the main phase of the microstructure is upper bainite (UB) which comprises bainitic ferrite laths that are approximately parallel to each other and also of intragranularily nucleated acicular ferrite. In addition to UB, the microstructure shown in FIG. 2 comprises quasipolygonal ferrite (QPF), which can be identified from the dark uplifting areas in SEM graphs, for instance. FIG. 3 shows an enlargement of FIG. 2.

The thickness of the steel strip is less than 12 mm. Also 10 mm may be applied for upper limit of the strip thickness. However, for process technical reasons, the strip may have thickness lower limit such as 1.5 mm or 3 mm. It is clear without saying that the term strip includes also sheets made from steel strip.

Preferably the yield strength $R_{p0.2}$ of the steel strip is in the range of 840-1050 MPa, or in the range of 900-1050 MPa or most preferably in the range of 840-959 MPa. Such a high strength is due to the bainite formation at low temperature defined by the chemistry.

The yield ratio ($R_{p0.2}/R_m$) of the steel strip is more than 0.85 or preferably in the range of 0.85-0.98 in order to provide that the steel strip product can be used as a structural steel.

Experiments

The following table 1 shows the chemical compositions of steels A and F used in these disclosed experiments. As can be noticed, the Bs-value of reference composition F was not satisfying the condition 602.1−421.1*Nb<Bs<692.1−421.1Nb.

TABLE 1

| Chemical compositions | | | | | | | | | | | |
|---|---|---|---|---|---|---|---|---|---|---|---|
| Steel | C | Si | Mn | P | S | Al | Nb | V | Cu | Cr | Ni |
| A | 0.068 | 0.21 | 1.4 | 0.0090 | 0.002 | 0.04 | 0.040 | 0.01 | 0.01 | 0.51 | 0.05 |
| F (REF) | 0.097 | 0.27 | 1.1 | 0.0090 | 9E−04 | 0.03 | 0.003 | 0.01 | 0.01 | 1.21 | 0.40 |

| Steel | N | Mo | Ti | Ca | B | Bs | Bs (min) = 602.1 − 421.1 * Nb | Bs (max) = 692.1 − 421.1 * Nb |
|---|---|---|---|---|---|---|---|---|
| A | 0.0053 | 0.03 | 0.032 | 0.0026 | 0.0015 | 649.8 | 585.3 | 675.3 |
| F (REF) | 0.0045 | 0.20 | 0.023 | 0.0016 | 0.0018 | 587.6 | 600.8 | 690.8 |

Bs = 830 − 270 * C − 90 * Mn − 37 * Ni − 70 * Cr − 83 * Mo

Table 2 below shows the process used and the mechanical properties obtained in the experiments.

In this table 2 column "direction" depicts the direction of mechanical testing. In tensile testing, "LONG" means that the tensile specimen has been in longitudinal direction to the rolling direction and "TRANS" means that the tensile specimen has been in transversal direction to the rolling direction. In impact toughness testing, "LONG" means that impact bar has been in transversal direction to the rolling direction and "TRANS" means that impact bar has been in longitudinal direction to the rolling direction.

Further the results of bendability test are given in two directions, depending on the axis of the bend: "LONG" means that the bend has been in longitudinal direction to the rolling direction and "TRANS" means that the bend has been in transversal to the rolling direction.

Next the experiments are described in more detail.

Experiments REF1-REF3 show the references according to the state of art. Here steel F having the reference chemical composition shown in table 1 was used. Here the slab was austenitized by heating to a temperature of 1200-1350° C. and subsequently equalized. Further such steel slab was reduced by hot-rolling in several hot rolling passes at a temperature range in which austenite recrystallizes. Further reducing was continued in several hot-rolling passes of a strip rolling mill and final rolling temperature higher than $A_{r3}$ was used. The final thickness of the steel strip was 10 mm. After the last pass in the strip rolling mill, the steel strip was subjected to direct quenching by a using cooling rate of at least 25° C./s to a quenching stop temperature (QST) lower than 400° C. As be seen from the results, the bendability value, i.e. the minimum permissible internal bending radius was only 3.5 and 3.0, depending on bending direction.

However, in the experiments INV1-INV6 according to the present invention, the steel A having the chemical composition shown in table 1 was used. Here the slab was austenitized by heating to a temperature of 1200-1350° C. and subsequently equalized. Further such steel slab was reduced by hot-rolling in several hot rolling passes at a temperature range in which austenite recrystallizes. Further reducing was continued in several hot-rolling passed of a strip rolling mill and final rolling temperature higher than $A_{r3}$ was used. The final thickness of the steel strip was 10 mm. After the last pass in the strip rolling mill, the steel strip was subjected to direct quenching by using cooling rate of at least 25° C./s to a quenching stop temperature (QST) lower than 550° C. As can be seen from the results, the yield strength $R_{p0.2}$ was within the targets of the present invention and the bendability has improved significantly. Therefore the object of the invention is clearly fulfilled.

In addition the impact toughness has improved significantly. As can be seen from the results INV1-INV6, the present invention enables ex cellent combination of ultra-high strength, bendability and low temperature impact toughness. As can be understood, if the thickness of the steel strip is lower than 10 mm, even better values for bendability are obviously obtained.

Further experiments INV7-INV11 were carried out according to INV1-INV6. As can be seen also from these results, excellent strength-toughness balance can be observed by means of different embodiments of the present invention.

It will be obvious to a person skilled in the art that, as the technology advances, the inventive concept can be implemented in various ways. The invention and its embodiments are not limited to the examples described above but may vary within the scope of the claims.

TABLE 2

Process and mechanical properties of the experiments

| Test | Steel | HT (deg C.) | FRT (deg C.) | QST (deg C.) | Direction | t (mm) | Rp0.2 (MPa) | Rm (MPa) | Rp0.2/ Rm | A5 (%) | Bendability (min. R/t) LONG | Bendability (min. R/t) TRANS | Impact toughness (Charpy-V J/cm2) (−40 deg C.) | Impact toughness (Charpy-V J/cm2) (−60 deg C.) |
|---|---|---|---|---|---|---|---|---|---|---|---|---|---|---|
| REF1 | F | 1200-1350 | >Ar3 | <400 | LONG | 10 | 1001 | 1093 | 0.92 | 10.7 | 3.5 | 3.0 | 85 | |
| REF2 | F | 1200-1350 | >Ar3 | <400 | LONG | 10 | 1035 | 1205 | 0.86 | 11.8 | | | 63 | |
| REF3 | F | 1200-1350 | >Ar3 | <400 | LONG | 10 | 1005 | 1179 | 0.85 | 12.5 | | | 45 | |
| INV1 | A | 1200-1350 | >Ar3 | <550 | TRANS | 10 | 897 | 973 | 0.92 | 10.2 | 2.2 | 1.2 | | 60 |
| INV2 | A | 1200-1350 | >Ar3 | <550 | TRANS | 10 | 951 | 1028 | 0.93 | 10.0 | | | | 157 |
| INV3 | A | 1200-1350 | >Ar3 | <550 | TRANS | 10 | 903 | 984 | 0.92 | 10.1 | | | | 107 |
| INV4 | A | 1200-1350 | >Ar3 | <550 | LONG | 10 | 896 | 949 | 0.94 | 11.1 | | | 113 | 52 |
| INV5 | A | 1200-1350 | >Ar3 | <550 | LONG | 10 | 873 | 945 | 032 | 11.5 | | | 122 | 112 |
| INV6 | A | 1200-1350 | >Ar3 | <550 | LONG | 10 | 892 | 954 | 0.94 | 10.7 | | | 113 | 62 |
| INV7 | A | 1200-1350 | >Ar3 | <550 | TRANS | 10 | 921 | 991 | 0.93 | 07.4 | | | | 100 |
| INV8 | A | 1200-1350 | >Ar3 | <550 | TRANS | 10 | 922 | 998 | 0.92 | 09.3 | | | | 67 |
| INV9 | A | 1200-1350 | >Ar3 | <550 | TRANS | 10 | 923 | 1018 | 0.91 | 09.9 | | | | 148 |
| INV10 | A | 1200-1350 | >Ar3 | <550 | LONG | 10 | 879 | 948 | 0.93 | 10.4 | | | 98 | 58 |
| INV11 | A | 1200-1350 | >Ar3 | <550 | LONG | 10 | 857 | 942 | 0.91 | 11.0 | | | 125 | 82 |

The invention claimed is:

1. A hot-rolled steel strip product having a yield strength $R_{p0.2}$ of at least 840 MPa, yield ratio ($R_{p0.2}/R_m$) of more than 0.85 and a thickness of less than 12 mm, whose composition in percentage by weight is C: 0.03-0.08,
Si: 0.01-0.8,
Mn: 0.8-2.5,
Al: 0.01-0.15,
Cr: 0.01-2.0,
B: 0.0005-0.005,
Nb: 0.005-0.07,
Ti: 0.005-0.12,
N: <0.01,
P: <0.02,
S: <0.004, and optionally Ca less than 0.01, V less than 0.1, Mo less than 0.5, Cu less than 0.5 and Ni less than 0.5, the rest being Fe and unavoidable impurities, and having a microstructure comprising upper bainite, wherein the hot-rolled steel strip has a microstructure comprising more than 80% upper bainite in terms of area percentages, wherein a bending radius of the hot-rolled steel strip product is less than 3.5*t in both directions in relation to rolling direction, without visually noticeable cracks or surface waviness in the bend.

2. The hot-rolled steel strip product according to claim 1, wherein the upper limit of martensite, martensite austenite constituent, perlite or polygonal ferrite is 20% in terms of area percentages.

3. The hot-rolled steel strip product according to claim 1, wherein the composition further satisfies the following equation:

$$Bs<692.1-421.1Nb,$$

wherein Bs=830−270*C−90*Mn−37*Ni−70*Cr−83*Mo, where Nb, C, Mn, Ni, Cr and Mo are the amounts of respective elements in the steel in wt-%.

4. The hot-rolled steel strip product according to claim 3, wherein the composition further satisfies the following equation:

$$602.1-421.1*Nb<Bs<692.1-421.1Nb,$$

wherein Bs=830−270*C−90*Mn−37*Ni−70*Cr−83*Mo, where Nb, C, Mn, Ni, Cr and Mo are the amounts of respective elements in the steel in wt-%.

5. The hot-rolled steel strip product according to claim 1, wherein C in the range of 0.03-0.075 in percentage by weight.

6. The hot-rolled steel strip product according to claim 1, wherein Nb is in the range of 0.02-0.05 in percentage by weight.

7. The hot-rolled steel strip product according to claim 1, wherein Ti is in the range of 0.005-0.03 in percentage by weight.

8. The hot-rolled steel strip product according to claim 1, wherein the hot-rolled steel strip product has a yield strength $R_{p0.2}$ of more than 900 MPa.

9. The hot-rolled steel strip product according to claim 1, wherein the hot-rolled steel strip product has a yield strength $R_{p0.2}$ from 900 MPa to 1050 MPa.

10. The hot-rolled steel strip product according to claim 1, wherein the hot-rolled steel strip product has a yield strength $R_{p0.2}$ of more than 857 MPa.

11. The hot-rolled steel strip product according to claim 1, wherein the hot-rolled steel strip product has a yield strength $R_{p0.2}$ from 857 MPa to 1035 MPa.

12. The hot-rolled steel strip product according to claim 1, wherein the bending radius of the hot-rolled steel strip product is less than 3.0*t in both directions in relation to rolling direction, without visually noticeable cracks or surface waviness in the bend.

* * * * *